United States Patent [19]

Bozung et al.

[11] 4,177,005

[45] Dec. 4, 1979

[54] VARIABLE-THROAT SPIRAL DUCT SYSTEM FOR ROTARY STREAM-FLOW MACHINES

[75] Inventors: Hans-Günther Bozung, Neusäss-Westheim; Hans Mendle, Augsburg, both of Fed. Rep. of Germany

[73] Assignee: Maschinenfabrik Augsburg-Nürnberg Aktiengesellschaft (M.A.N.), Augsburg, Fed. Rep. of Germany

[21] Appl. No.: 926,021

[22] Filed: Jul. 19, 1978

Related U.S. Application Data

[63] Continuation of Ser. No. 720,735, Sep. 7, 1976, abandoned.

[30] Foreign Application Priority Data

Sep. 6, 1975 [DE] Fed. Rep. of Germany ..... 2539711

[51] Int. Cl.[2] ..... F01D 9/00; F01D 17/12

[52] U.S. Cl. ..... 415/128; 415/151; 415/204

[58] Field of Search ..... 415/126, 127, 128, 151, 415/166, 184, 185, 186, 203, 204, 205, 206, 207, 208; 60/600, 602

[56] References Cited

U.S. PATENT DOCUMENTS

| | | | |
|---|---|---|---|
| 249,802 | 11/1881 | Smith | 415/204 |
| 1,390,391 | 9/1921 | Skidmore | 415/204 |
| 1,412,257 | 4/1922 | Petsche | 415/151 |
| 1,955,683 | 9/1931 | Reiffenstein | 415/151 |
| 2,190,670 | 2/1940 | Mann | 415/128 |
| 3,552,876 | 1/1971 | Updike | 415/205 |

FOREIGN PATENT DOCUMENTS

| | | | |
|---|---|---|---|
| 26130 | of 1907 | United Kingdom | 415/128 |
| 697748 | 9/1953 | United Kingdom | 415/208 |

*Primary Examiner*—Louis J. Casaregola

*Attorney, Agent, or Firm*—Frishauf, Holtz, Goodman & Woodward

[57] ABSTRACT

The inner spiral wall of each spiral feed duct of a turbine is provided with a slidable extension tongue with an end portion of spiral curvature mounted on a carrier plate for rotation about the machine axis. Movement of the tongue to extend the length of the inner duct wall reduces the exit cross-section of the duct while keeping a spiral shape at the duct end. The tongue may be mounted on a portion of the machine casing that is made integral with the discharge duct that is coaxial with the machine and is mounted axially rotatable on the machine casing. When an axial flow rotor is used, the ducts and tongues have deflecting rims and the tongues have end walls at the rim ends to define the zone of communication between the rotor and each duct. One of the applications of the invention is to exhaust gas driven superchargers for internal combustion engines. A discharge spiral for a rotary pump or compressor may be similarly equipped.

5 Claims, 7 Drawing Figures

FIG. 1
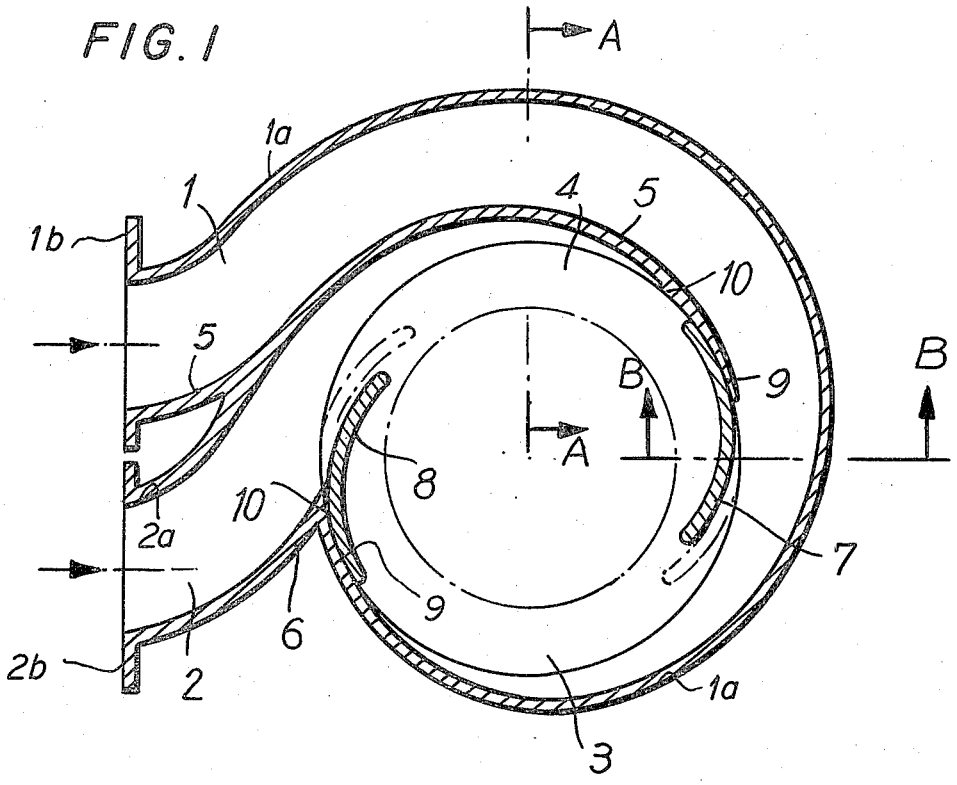
FIG. 3A
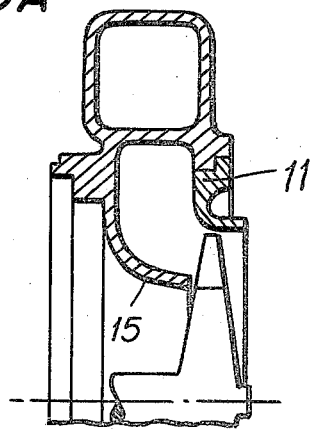
FIG. 2A
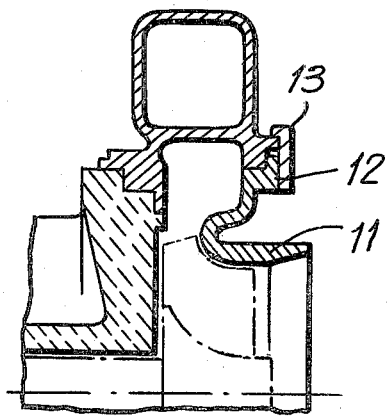
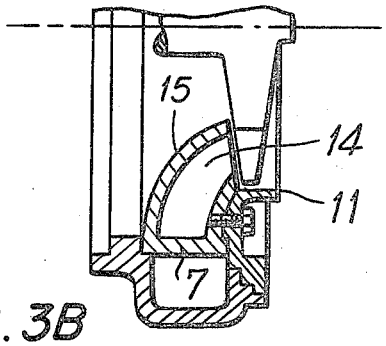
FIG. 3B
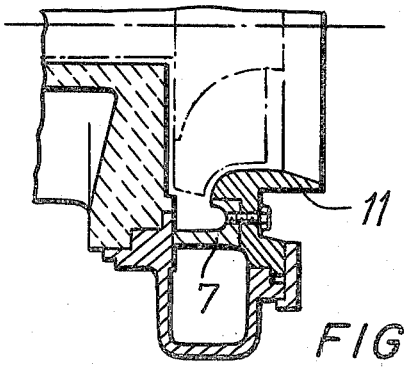
FIG. 2B

VARIABLE-THROAT SPIRAL DUCT SYSTEM FOR ROTARY STREAM-FLOW MACHINES

This is a continuation, of application Ser. No. 720,735, filed Sept. 7, 1976 (abandoned).

This invention relates to a spiral duct system for a rotary-type, stream-flow machine having an at least partially adjustable duct cross-section. Such a duct system may be referred to as a variable-throat spiral duct system.

The invention is applicable broadly to stream-flow machines in which a rotary shaft is coupled to the flow of a gas or liquid, either for producing rotation of the shaft by the energy of the flow of the flow medium or applying the power of the shaft to produce a flow of the medium, in each case utilizing an appropriately equipped rotor on the shaft. The invention is particularly useful for turbosuperchargers driven with the exhaust gas of the engine served by the supercharger. The turbines and compressors used in exhaust gas driven superchargers must be accurately fitted to the throughput relations and charging pressure requirements of the engine in order to obtain satisfactory efficiency. The so-called guide wheels or vane wheels that merely make possible a trimming of the device within narrow limits and are expensive to produce are largely avoided in practice, but it is possible to obtain the objective by changing the cross-section of the spiral duct that is used.

In Austrian Pat. No. 168 357, a device of the latter kind is disclosed in which a lateral wall of the spiral-shaped input channel for the turbine of an exhaust driven supercharger is actually adjustable over the entire spiral circumference by means of bush rods. It is readily appreciated that in such an arrangement, with a piston-like adjustable wall operating over the entire spiral circumference, the provision of gastight seals becomes the dominant problem. Furthermore, in this case the seal surfaces are particularly vulnerable to accumulation of dirt. The known device therefore is poorly suited for control or regulation of the turbine. It is further to be recognized that on account of the axial shift of the lateral wall of the spiral duct in the known system, a sudden change in cross-section takes place in the transition between the fixed and adjustable sidewall regions. It is not known whether that type of device has ever resulted in a practical embodiment. The evident disadvantages mentioned above must in any event have been responsible for the fact that this known device has left no traces in present-day technology.

It is the object of the present invention to provide a simple, economical and reliable device for adjusting the flow behavior of a spiral duct to the conditions of the particular rotary machine, and particularly to do so for a spiral feed duct of a turbine or for a spiral discharge duct of a rotary pump or blower.

SUMMARY OF THE INVENTION

Briefly, at the extremity of radially the inner wall of a spiral duct communicating with the rotor space, which extremity is of course overlapped considerably by the corresponding radially outer circumferential wall, a tonguelike extension is provided in the form of a tongue having a circularly curved portion that slides snugly against the surface of the inner wall and a spirally curved free end portion and which is shiftable so as to form an adjustable extension of the inner wall that constricts the duct as the tongue is extended to prolong the inner wall spirally opposite the inwardly spiralling outer wall. The extension of the inner wall does not reduce the essentially full circle circumferential arc over which the duct system communicates with the rotor space, but merely shifts it, because the tongue performs the normal function of the end of the inner wall of the spiral with both its inner and outer surfaces. Two or more spiral ducts may be coiled together so that the inner wall of one provides at least a part of an outer wall of another and in such a case, a tongue is provided for extending adjustably the inner wall of each of the ducts in the same fashion, the tongues being preferably mounted on a common carrier and adjusted at the same time. Especially when two or more tongues are provided, they are advantageously adjusted by a rotary movement about the machine axis and preferably they are carried on a member another part of which forms a tubular axial housing on the side of the machine which is the side functionally opposite from the spiral duct system. This is in practice the lower pressure side of the machine (the discharge of a turbine or intake of a pump or compressor).

Desired flow conditions can thus be established by simply varying the throat cross-section of the spiral duct or ducts. There are no problems whatever regarding the sealing of the duct to the exterior and the device is not vulnerable to contamination by dirt. The adjustment of the effective cross-section of the duct or ducts can be made smoothly and continuously (i.e. without limitation of the minimum amount of change). This is particularly useful for turbosuperchargers of motors which require a favorable torque characteristic over a wide range of operating conditions. It is possible by this invention to produce the required high supercharging air pressure under partial load conditions of the motor. A further particular advantage of the invention is to be found in the fact that for different rotor contours, which also require different duct throat cross-sections, the same shape of spiral duct can be used in most cases by the provision of tongues in a sufficient variety of suitable shapes. The advantages according to the invention are effective for the feed ducts for both radial and axial flow turbines and also for the discharge duct of a rotary blower, compressor or pump.

The carrier, as mentioned above, may be part of a tubular conduit extending coaxially outward on the lower pressure side of the machine. It is practical to affix the tongue or tongues detachably on the tongue carrier member. In that way the use of tongues of different shapes can, in a very simple way, vary the particular range of duct throat cross-section that is obtainable, and hence of the tongue load on the shaft, which is of great importance for the efficiency both of turbines and of fluid-moving machines. This factor is also of importance for voiding excitation of vibrations in the machine. The maintenance of this factor under the desired conditions for a particular machine or model of machine is thus simply made a matter of providing the necessary tongues, which are relatively small and cheap.

An axial flow rotor is usable if the ducts and tongues have deflecting rims for the transition between axial and spiral flow, and in this case the tongues must also have radially inwardly turned extremities to define the circumferential impingement boundary.

FIG. 1 is a diagrammatic cross-section of a spiral duct system according to the invention for a radial flow turbine with two output connections;

FIG. 2A is a sectional view along the line A—A of FIG. 1;

FIG. 2B is a sectional view along the line B—B of FIG. 2;

FIGS. 3A and 3B are cross sections of the same kind as those of FIGS. 2A and 2B respectively representing another embodiment of the invention which is a spiral feed duct system for an axial flow turbine;

Figure 4:
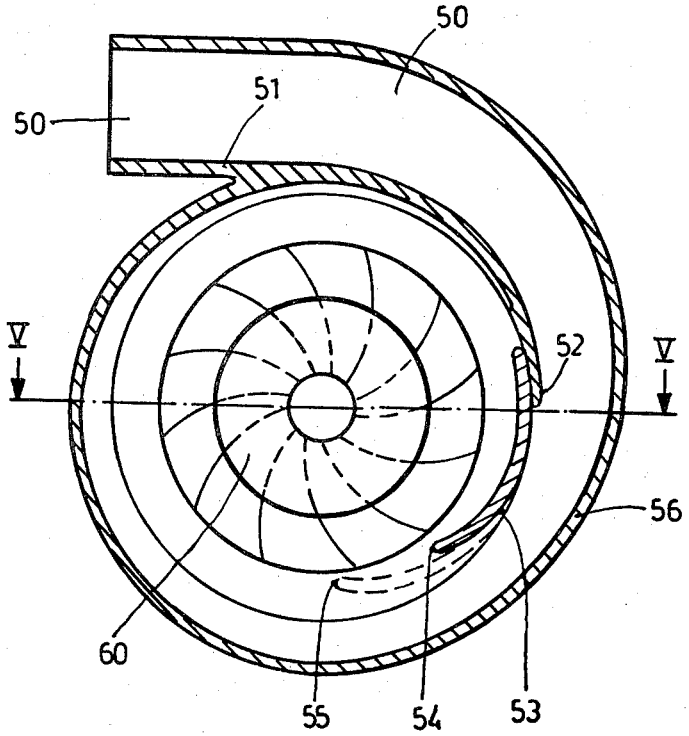
FIG. 4 is a diagrammatic cross-section of a spiral duct system, according to the invention, with a single spiral duct serving a turbine.

The spiral feed duct system for a radial turbine shown in FIG. 1 has two input connections respectively connecting with two spiral ducts 1 and 2, leading respectively to rotor drive segments 3 and 4 of the turbine that are offset by about 180° with respect to each other. The spiral duct 1 has a radially outer wall 12 and radially inner wall 5 and is brought spirally around the location where the duct 2 has its driving or impingement region around the turbine rotor and is separated from that driving region by its inner wall 5. The drivregion 3 that follows the end of wall 5 extends circumferentially to where it is terminated by the spiral surface of the radially inner wall 6 of the spiral duct 2, at the end of which the drive region 4 begins. The spiral duct 2 utilizes the wall 5 as its radially outer wall except for a small entrance part of the duct which has the wall 2*a* that merges into the wall 5. In accordance with the invention, movable tongues 7 and 8 are provided for respectively constituting the ends of the radially inner wall 5 of the duct 1 and of the radially inner wall 6 of the duct 2 respectively, and for extending the lengths of those respective spiral walls. The tongues 7 and 8 are circumferentially movable on an adjusting carrier member that is not shown in FIG. 1 in order to simplify the illustration. The tongues 7 and 8 in the illustrated example have faired surfaces 9 curved in circular profile that are arranged to slide flush against the similarly faired surfaces 10 of the adjacent radially inner wall of a spiral duct as the unshown carrier member is rotated about the machine axis. In the case of the duct 2 and the tongue 8, the faired surface 10 is partly on the end wall 6 of duct 2 and partly on the portion of the wall 1*a* that merges into the end of the wall 6. The surfaces of the tongues and of the adjacent wall are made to fit as closely flush to each other as possible, in order to avoid flow energy losses in the region of the engagement of the tongue with the wall of the spiral duct. Actually, only a line contact is necessary but flushly sliding surfaces are helpful where they can conveniently be provided because wear from sliding is distributed and hence less important. The radially inner wall 5 is accordingly tapered in the circumferential direction in the region where it is close to the tongue 7 and, likewise, the inner wall 6 of the duct 2 forms a cusp after meeting the outer wall 1*a* of the duct 1. The difference in shape between the two spiral ducts is because it is desired to have their individual external input connections 1*b* and 2*b* adjacent to each other but to have their inner ends reach rotor drive regions at opposite sides of the turbine rotor.

The end portions of the tongues 7 and 8 depart inwardly from the axis-centered circular curvature necessarily provided for the surfaces sliding on the adjacent walls 5 and 6, respectively, and preferably have spiral arc curvature.

Displacement of the shiftable tongues 7 and 8 incidentally produces an advance or a setback of the beginning of the drive regions 3 and 4 and may thereby, in the case of some designs, produce a variation of the angular momentum relations between the flow medium of the shaft. The drive regions are merely shifted, not reduced, however, since the inner surface of the tongues define their circumferential ends as clearly appears in FIG. 1, the essential effect of tongue displacement is a variation of the duct throat cross-section (which is the cross-section of the spiral duct at the end of the tongue).

The throat cross-section of the spiral ducts has its maximum value for the position of the tongues 7 and 8 shown in solid lines in FIG. 1. The position for minimum throat cross-section is indicated by dashed lines showing where the ends of the tongues would be in that condition. Any intermediate value can very practically be obtained by an infinitely variable adjustment (variable without discrete steps). This adjustment can either be fixed after a preliminary design or installation decision or can be subjected to continuous regulation, as can be of advantage for example in the case of supercharger turbines for truck motors, which need a favorable torque characteristic for the various load situations at all times for their most effective operation. The arrangement shown accordingly makes it possible, by the provision of tongues according to the invention that are shiftable circumferentially about the axis of the machine, to provide an adjustment of the flow behavior of each feed spiral to the required conditions. Since the tongues 7 and 8 provided according to the invention are located inside the spiral duct assembly, problems of sealing off of leakage to the exterior of the machine do not arise.

The tongues 7 and 8 can practically and effectively be affixed to a tongue carrier member mounted rotatably in the machine frame location for rotation about the axis of the machine. As can be seen in FIGS. 2A and 2B in the case of radial flow turbines, where the driving gas enters at the edge of the turbine and then comes out along the hub of the rotor after being deflected into an axial direction, the tubular discharge duct 11 coaxial with the machine can advantageously be utilized as an axially rotatable member for mounting the tongues 7 and 8. The discharge duct 11 is provided with a machined mounting flange 12 that is set in the casing of the spiral duct system. In the illustrated example the mounting flange 12 is secured in the desired setting by being pressed by a tightening ring 13 hard against its base in the casing. Such an arrangement is advantageous if it is necessary merely to set the position of the tongues once and for all. Otherwise, if it were for example desirable to provide automatic control of the position of the tongues 7 and 8 continuously during operation of the machine, the discharge pipe 11 with its flange carrying the tongues 7 and 8 could be rotatably mounted in an appropriately sealed antifriction bearing and its rotational position could be controlled by providing gear teeth on the outside of the tube 11 engaging a gear train or by providing link rods connecting to a positioning drive. The tongues 7 and 8 could be cast as a unit with the discharge pipe 11. For simplification of the rotatable mount, however, it is practical as in FIG. 2B, to attach the tongues detachably to the rotatable tongue carrier member. In this case, tongues of different size and of different curvature can be held on the bearing platform on which they are mounted and suitably selected for the particular case. The possibility of variation of the machine characteristics are thereby extraordinarily widely extended.

The basic construction of the device illustrated in FIGS. 3A and 3B corresponds to a very large extent to the illustrative embodiment already described. Corresponding parts, therefore, have been given the same reference numerals.

FIGS. 3A and 3B show an axial flow turbine in which the gas supplied by the spiral feed duct system is deflected into an axial direction of flow before it engages the vanes of the turbine rotor. Both the spiral ducts and the tongues must in this case have deflecting rims 15 for bringing the gas into an axial direction of flow incidentally limiting the radial dimension of the zone of impingement on the rotor. In order to prevent gas already supplied to the rotor from mixing or interfering with gas freshly arriving before entering the rotor intervane channels, the circumferential extent of the zone of impingement of the gas on the turbine vanes must be terminated and in this case, therefore, each tongue carries a radially directed tongue end 14 cupping with the adjacent rim 15 as shown in FIG. 3B for the tongue 7; to define the end of the impingement zone 4. The tongues according to the invention, which here are additionally provided with a radial limiting wall, could in this case also be made integral with the discharge duct 11 which, is again mounted rotatably in the casing of the machine but are conveniently fastened detachably to the duct 11, as shown in FIG. 3B.

FIG. 4 shows a spiral duct system consisting of a single spiral duct 50 instead of the two spiral ducts in the system illustrated in FIG. 1. The radially innerwall 51 of the duct 50 near its end 52 engages the tongue 53 snugly which extends effectively the inner wall 51 to the tongue extremity 54. The tongue 53 can be advanced by a rotary movement, by means not shown in the drawing, to the position shown in the broken lines, where the extremity reaches the position 55. It is evident that the dashed line position of the tongue 53 brings it closer to the inwardly spiralling outer wall 56 of the duct 50. It is also evident from FIG. 4 that the outer wall 56 ultimately merges with the inner wall 51, so that the tongue 53 at its inner surface also in effect defines the end of the outer wall 56, so that the flow medium in the duct 50 communicates with substantially 360° of the circumference of the rotor 60, whatever the position of the tongue 53.

Figure 5:
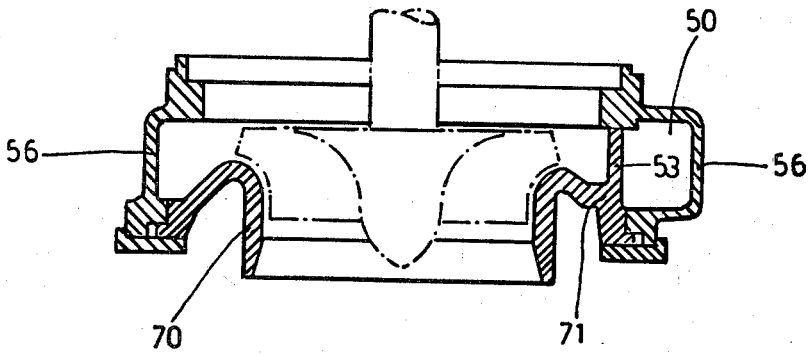
FIG. 5 is a diagramatic longitudinal section of a spiral duct system according to the invention providing for the discharge from a centrifugal blower-compressor.

FIG. 5 shows, in axial cross-section, a centrifugal blower-compressor utilizing a spiral discharge duct in accordance with the present invention.

It is assumed that the end view cross-section of the spiral duct in this case has the form shown in FIG. 4 (the diagram of FIG. 4 can also represent the spiral input duct to a radial flow turbine). For this reason corresponding parts are indicated by the same reference numerals as are used in FIG. 4. The sectional view shown in FIG. 5 corresponds to a section that would intersect the drawing of FIG. 4 on a horizontal line through the center of the rotor 60, viewed from above. The inlet duct 70 of the blower is in this case of course axial and it again can be made rotatable about the axis of the machine so that a flange provided in its mounting can serve to carry the shiftable tongue 53.

Although the invention has been described in detail with reference to particular illustrative embodiments, it will be understood that the designer of stream-flow rotary machines has a wide range of opportunities to provide variations and modifications within the inventive concept.

We claim:

1. A variable-throat spiral duct system for a stream-flow machine in which shaft motion is coupled to flow of a gas or liquid, comprising:

a machine having an axial shaft and a rotor carrying thereon means for engaging a flow medium;

at least one spiral duct leading spirally inwards to said rotor and having a radially outer wall and also a radially inner wall of less circumferential length than said radially outer wall;

a tongue-bearing insert member (11) rotatably and coaxially mounted in the structure of said machine and formed as part of a tubular pipe forming part of the flow path of said medium on the axially and functionally opposite side of said machine from said spiral duct system;

at least one tongue affixed to said insert member and thereby mounted slidably and snugly adjacent to the extremity of said inner wall and having a free end portion of spiral curvature and another portion having a surface of circular curvature, said inner wall extremity having a matching inwardfacing surface portion of circular curvature, and being tapered towards its circumferential extremity in the vicinity of said tongue, such a tongue (7,8) being provided for the inner wall (5,6) extremity of each said spiral duct (1,2), and means for so shifting each said tongue, by moving said tongue-bearing member, as to provide a variable extension of said inner wall(s) and thereby to reduce the throat cross-section of the duct between the tongue and said radially outer wall of the duct.

2. A spiral duct system as defined in claim 1 in which each said tongue (7,8) is detachably connected to said tongue-bearing member (11).

3. A spiral duct system as defined in claim 1, in which there are a plurality of said ducts (1,2) with individual external connections, said radially outer wall of at least some of said ducts being at least for some small length provided by a structure that also provides at least part of said radially inner wall of another of said ducts, and in which the tongues (7,8) provided for cooperation with the extremities of the respective radially inner walls of said ducts are mounted on a common tongue-bearing member (11).

4. A spiral duct system as defined in claim 3, in which there are two of said ducts (1,2), and in which the said radially inner wall (5) of a first one of said ducts is provided by a partition that forms a major part of said radially outer wall of the second one of said ducts, and in which said radially outer wall of said first one of said ducts meets the radially inner wall (6) of the second of said ducts to form a cusp and provides adjacent thereto a surface portion of circular curvature flush with the surface (10) of circular curvature of the extremity of said inner wall (6) of said second duct.

5. A spiral duct system as defined in claim 2, in which said rotor is of the axialflow type and in which system each said duct and tongue has a reflecting rim (15) extending therefrom for guiding said flow medium into an axial direction of flow for impingement on said rotor, and in which, further, the free extremity of each tongue is inwardly turned (14) so as to cup with said rim for defining an impingement zone of rotor and flow medium on the inward side of the tongue.

* * * * *